United States Patent [19]
Berkley
[11] 4,440,060
[45] Apr. 3, 1984

[54] ACCELERATION ACTUATED LANYARD DEVICE

[75] Inventor: George A. Berkley, Brigham City, Utah

[73] Assignee: Thiokol Corporation, Chicago, Ill.

[21] Appl. No.: 401,182

[22] Filed: Jul. 23, 1982

[51] Int. Cl.³ ..... F41F 5/02
[52] U.S. Cl. ..... 89/1.5 D; 102/221
[58] Field of Search ..... 89/1.5 D, 1.5 R; 102/221, 222, 247, 486

[56] References Cited

U.S. PATENT DOCUMENTS 3,515,071 6/1970 Brackman ..... 89/1.5 D X
3,625,106 12/1971 Russo ..... 89/1.5 D
3,760,682 9/1973 Dexter ..... 89/1.5 D
3,939,754 2/1976 Dexter ..... 89/1.5 D
4,299,157 11/1981 Burns et al. ..... 89/1.5 D

*Primary Examiner*—David H. Brown
*Attorney, Agent, or Firm*—Gerald K. White

[57] ABSTRACT

The lanyard that is pulled by a parachute to ignite a flare is cut and a safety coupling inserted. One end of the lanyard is fastened to a small housing that holds a shear pin and a much heavier, acceleration-actuated pin. The other end of the lanyard forms a loop that encompasses both pins. If the lanyard is pulled at low accelerations, the shear pin is broken and the lanyard separates. At high accelerations, however, the acceleration-actuated pin is inserted into the lanyard loop, by force of the acceleration, and prevents separation of the lanyard.

7 Claims, 3 Drawing Figures

ACCELERATION ACTUATED LANYARD DEVICE

BACKGROUND OF THE INVENTION

1. Field of the Invention

This invention relates to lanyard actuated pyrotechnic devices such as flares or rockets that are launched from an aircraft and/or suspended by a parachute, and more particularly, to a safety device for preventing ignition initiation of such pyrotechnic devices during handling due to an accidental "pull" of the lanyard.

2. Description of the Prior Art

Many different pyrotechnic devices, such as military flares and rockets, utilize the pulling of a lanyard to release a firing pin to effect ignition or to perform other functions that must be executed after the pyrotechnic device clears a launcher or other hardware. A safety hazard exists with devices of this type in that if a flare or rocket motor is dropped during handling, for example, causing the lanyard inadvertently to be pulled, a very serious accident can result.

SUMMARY OF THE INVENTION

An object of the invention is to provide for use with lanyard-actuated pyrotechnic devices, such as flares or rockets, a safety device that is operative to prevent accidents due to inadvertent pulling of the lanyard by allowing flare or rocket ignition initiation upon such pulling only when the safety device is undergoing high acceleration such as experienced during ejection from a launcher.

In accomplishing this and other objectives of the invention, there is provided an acceleration-actuated lanyard safety coupling device that acts as a weak link in the lanyard when stationary or moving at low acceleration and a strong link when moving at higher accelerations. Thus, in accordance with the invention, a lanyard such, for example, as that pulled by a parachute to ignite a flare, is cut and a safety coupling or device is inserted between the opposing lanyard members or cut ends. One member or cut end of the lanyard is fastened to a small housing or holder that is attached to the flare or rocket by bonding, by the use of a shear pin, or other technique so that the housing stays with the payload. The other member or cut end of the lanyard is attached to a loop or attachment ring. The attachment ring extends through a slot in the housing and encircles a small diameter shear pin which normally retains the attachment ring in position. The attachment ring encircles a heavier and strong acceleration-actuated pin only when the acceleration-actuated pin is subjected to higher accelerations such as those experienced during ejection of the flare from a launcher.

With this arrangement, if the lanyard is pulled while the housing and flare are stationary or moving at low accelerations, the shear pin is sheared or broken, and as a result, the lanyard separates and is ineffective to actuate the firing pin or other initiating mechanism that is attached to or embodied in the flare. At higher accelerations, however, the acceleration-actuated pin is actuated by the force of the acceleration and is inserted in the attachment ring and prevents separation of the opposed members or cut ends of the lanyard, and the lanyard is effective, when pulled, to initiate ignition of the flare.

BRIEF DESCRIPTION OF THE DRAWINGS

Having summarized the invention, a detailed description follows with reference being had to the accompanying drawings which form part of the specification, of which.

DESCRIPTION OF THE PREFERRED EMBODIMENT

Figure 2:
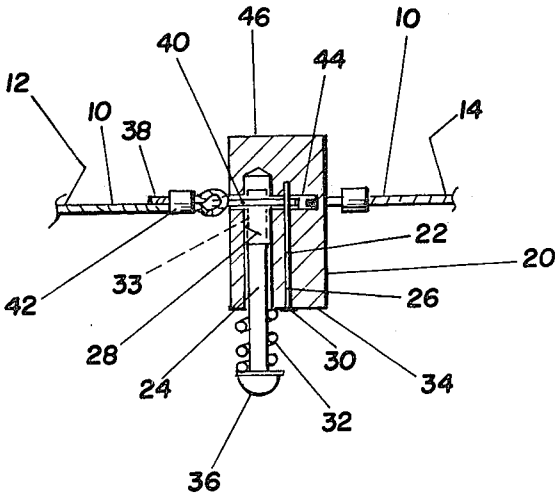
FIG. 2 is a cross sectional view taken along the lines 2—2 of FIG. 1.

Indicated in the drawings by the reference numeral 10 is a lanyard such as that pulled by a parachute, for example, to ignite a flare (not shown). One end 12 of the lanyard 10 is fixedly attached to a parachute cable (not shown) and the other end 14 is attached to the flare for releasing ignition restraining means associated therewith, and thereby initiating ignition of the flare, when the lanyard 10 is pulled.

As shown in the drawings, the lanyard 10 is cut and a safety coupling or acceleration-actuated lanyard device, indicated at 16, is inserted therein. One cut end 18 of the lanyard 10 is fastened to a cylindrical housing or holder 20 of the device 16. Included within housing 20 is a shear retaining pin 22 and a much heavier and stronger acceleration-actuated pin 24. Pins 22 and 24 are disposed in respectively associated bores 26 and 28 that are provided in housing 20 with their axes parallel to each other and to the cylindrical axis of housing 20. Pin 22 may be retained within bore 26 by tape 30. The pin 24 normally is held in a partially withdrawn position from bore 28 by an acceleration spring 32, one end of spring 32 being attached to the associated lower circular end face 34 of housing 20 and the other end to head 36 of pin 24 by any suitable means of attachment such as bonding.

The other cut end 38 of the lanyard 10 is connected to a loop attachment ring 40 that encircles the axes of bores 26 and 28, and normally is retained in position by pin 22 in bore 26. Cut end 38 of lanyard 10 is looped around attachment ring 40 and is fixed in position by a fitting 42.

Figure 3:
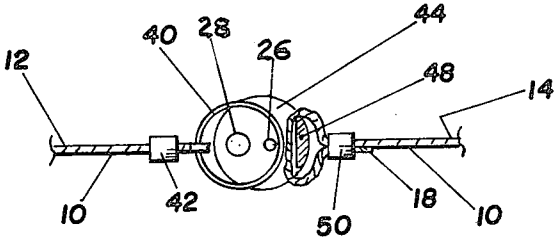
FIG. 3 is a cross sectional view taken along the lines 3—3 of FIG. 1.

As best seen in FIGS. 2 and 3, a slot 44 transverse to parallel bores 26 and 28 is cut in housing 20 for accommodating attachment ring 40. Slot 44 extends through the cylindircal housing 20 for a substantial portion of the diameter thereof, parallel to the housing circular end face 34 and an upper circular end face 46, and near the inner ends of bores 26 and 28. Attachment ring 40 normally is retained in slot 44 by shear pin 22 only. Due to the biasing action of spring 32, pin 24 is normally held in the partially withdrawn position shown.

By reference to FIG. 3, it is seen that an uncut portion 48 of housing 20 provides a support about which the cut end 18 of the lanyard 10 is looped and fixedly attached to the housing 20, as by a fitting 50.

The safety coupling or acceleration-actuated lanyard device 16 is characterized in that it acts as a weak link in the lanyard 10 at low accelerations in any direction and a strong link at higher accelerations, particularly higher accelerations having strong components of force along the axis of pin 24 in the direction from head 36 that effect compression of compression spring 32 and such as those experienced during ejection of a flare or rocket from a launcher. In this way, according to the invention, there is avoided the aforementioned hazards that are encountered in handling the prior art lanyard devices and systems.

Figure 1:
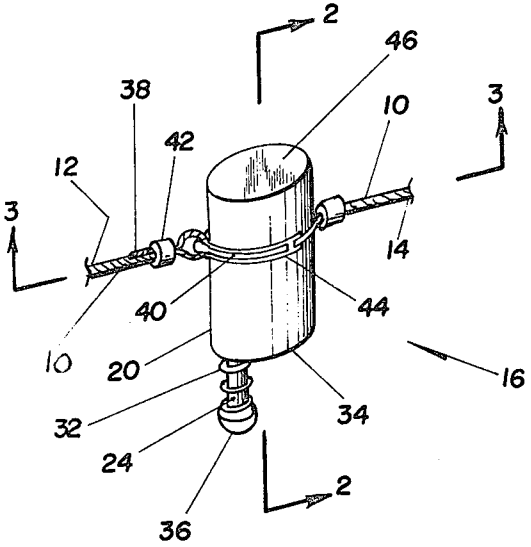
FIG. 1 is a perspective view of the safety device according to the present invention.

The housing or holder 20 may be attached at the upper circular end face 46 to the flare or rocket by bonding, by the use of a shear pin, or other technique so that the housing 20 stays with the flare or rocket, retaining the acceleration-actuated pin 24 in the position shown in FIGS. 1 and 2, until the lanyard 10 attached to the parachute or launcher pulls the housing 20 out of that position. By this time, the acceleration forces acting on pin 24 along the axis thereof in the direction from head 36 will have caused the acceleration pin 24 to compress the acceleration spring 32 and move to the position shown by phantom lines 33 in FIG. 2. The safety coupling 16 then acts as a strong link between the cut ends 18 and 38 of the lanyard 10 and actuates whatever device or mechanism is attached to the flare or rocket for initiating ignition thereof.

If, during handling, under a condition of low acceleration, the flare or rocket is dropped or otherwise manipulated so that the lanyard 10 is accidentally pulled, the acceleration spring 32 will prevent the acceleration pin 24 from engaging the attachment ring 40. As a result, the only link then connecting the cut ends 18 and 38 of the lanyard 10 is the small diameter shear pin 22 that normally retains the attachment ring 40 in proper position. The shear pin 22 is sized so that it will easily shear and release the attachment ring 40 before the housing 20 breaks free of the flare or rocket to which it is attached. In this way, the lanyard 10 is not pulled, preventing accidental initiation of the flare or rocket.

In summary, if the lanyard 10 is pulled at low accelerations, as the result, for example, of dropping during handling, the shear pin 22 is sheared or broken and the lanyard 10 separates. At higher accelerations, however, the acceleration-actuated pin 24 is inserted in the lanyard loop or attachment ring 40, by the force of the acceleration, and prevents separation of the lanyard 10.

The acceleration-actuated lanyard device 16 is characterized by its relative simplicity and ease of manufacture, assembly and installation, and reduces the hazards for those who assemble, disassemble, or otherwise handle dangerous flares or rockets.

Thus, in accordance with the invention, there has been provided a safety device or coupling 16 that is operative to prevent accidents due to inadvertent pulling of the lanyard of lanyard actuated pyrotechnic devices, as by dropping of the devices, by allowing ignition initiation thereof upon pulling of the lanyard only while the safety coupling is undergoing high acceleration. If the lanyard 10 is pulled with the safety coupling 16 stationary or moving at low acceleration, the shear pin 22 is sheared and the lanyard 10 separates and is ineffective to actuate the device or mechanism provided in the flare or rocket for initiation thereof. At high accelerations, the acceleration-actuated pin 24 is inserted in the lanyard attachment ring 40 by the force of the acceleration which compresses spring 32 and prevents separation of the lanyard 10.

I claim:

1. A safety coupling for coupling first and second members comprising, a housing having formed therein first and second bores and a slot, said slot being transverse to said bores, said housing having a connection to said first member; an attachment ring having a connection to said second member and normally disposed in said slot in encircling relation to both of said bores;

a first pin in one of said bores normally encircled by and retaining said attachment ring in said slot, said first pin being a shear pin;

acceleration responsive means including a second pin in the second one of said bores and a biasing means for exerting a biasing force on said second pin, said second pin being stronger than said first pin and normally biased by said biasing means to a position partially withdrawn from said second bore, in which position said second pin is ineffective to retain said attachment ring in said slot when force is applied to said first and second members to pull them apart, said first pin shearing upon the application of such force pulling said members apart whereby said safety coupling is unable to retain said members coupled, said second pin being moved against the force of said biasing means further into the second one of said bores to be encircled by and to retain said attachment ring in said slot notwithstanding the application of force to said first and second members to pull them apart when said acceleration responsive means is subjected to accelerations that produce a force of acceleration strong enough to overcome the force of said biasing means.

2. A safety coupling as specified in claim 1 wherein said first member comprises one cut end of a cut lanyard and said second member comprises the second cut of said cut lanyard.

3. A safety coupling as specified in claim 2 wherein said lanyard has an end adapted to be connected to a pyrotechnic device for initiating ignition thereof, when pulled.

4. A safety coupling as specified in claim 3 wherein said acceleration responsive means further includes a compression spring having a first end and a second end, said first end being connected to said housing and said second end connected to said acceleration-actuated pin.

5. A safety coupling as specified in claim 4 wherein the connection of said one cut end of said lanyard to said housing is formed by looping said one cut end around an uncut portion of said housing that is formed by the formation of said slot, and wherein the connection of said second cut end to said attachment ring is formed by looping said second cut end around said attachment ring.

6. A safety coupling for insertion between the cut ends of a cut lanyard and that is utilized, when pulled, to initiate ignition of a pyrotechnic device, comprising, a housing having formed therein first and second parallel bores and a slot, said slot being transverse to said bores, said housing having a connection to one of the cut ends of the lanyard;

an attachment ring having a connection to the other one of the cut ends of the lanyard and said attachment ring being normally disposed in said slot and encircling both of said first and second bores;

a retaining shear pin in one of said bores normally encircled by and retaining said attachment ring in said slot;

a compression spring;

an acceleration-actuated pin in the second of said bores, said acceleration-actuated pin being normally biased by said compression spring to a partially withdrawn position wherein it is ineffective to retain said attachment ring in said slot upon pulling of the lanyard and shearing of said retaining shear pin, said acceleration-actuated pin being moved by the force of acceleration further into said second one of said bores against the force of said compression spring to be encircled by and to retain said attachment ring in said slot when said acceleration-actuated pin is subjected to high accelerations having strong force components in a direction producing compression of said compression spring such as those experienced at ejection of the pyrotechnic device from a launcher;

whereby unless said acceleration-actuated pin is undergoing such acceleration, the lanyard, when pulled, is separated and rendered ineffective to initiate ignition of the pyrotechnic device.

7. A safety coupling as specified in claim 6 wherein the connection of said one of the cut ends of the lanyard to said housing is formed by looping said one cut end around an uncut portion of said housing that is formed by the formation of said slot, and wherein the connection of said other one of said cut ends of the lanyard to said attachment ring is formed by looping said other one of said cut ends around said attachment ring.

* * * * *

UNITED STATES PATENT AND TRADEMARK OFFICE

CERTIFICATE OF CORRECTION

PATENT NO. : 4,440,060

DATED : April 3, 1984

INVENTOR(S) : George A. Berkley

It is certified that error appears in the above–identified patent and that said Letters Patent are hereby corrected as shown below:

Claim 2, line 3 after "cut" , first occurrence, insert -- end --.

Signed and Sealed this

*Twenty-fifth* Day of *September 1984*

[SEAL]

*Attest:*

GERALD J. MOSSINGHOFF

*Attesting Officer*

*Commissioner of Patents and Trademarks*